US006699067B1

(12) United States Patent
Zhao et al.

(10) Patent No.: US 6,699,067 B1
(45) Date of Patent: Mar. 2, 2004

(54) BUSSED ELECTRICAL CENTER INCORPORATING MODULARIZED COMPONENTS AND SECTIONABLE CONDUCTOR GRID FOR ESTABLISHING PREFERRED HIGH CURRENT FLOW APPLICATIONS

(75) Inventors: Weiping Zhao, Canton, MI (US); Robert F. Gutman, Fraser, MI (US); Robert S. Migrin, Livonia, MI (US)

(73) Assignee: Alcoa Fujikura Limited, Franklin, TN (US)

( * ) Notice: Subject to any disclaimer, the term of this patent is extended or adjusted under 35 U.S.C. 154(b) by 0 days.

(21) Appl. No.: 10/319,994

(22) Filed: Dec. 16, 2002

(51) Int. Cl.[7] ..... H01R 27/00
(52) U.S. Cl. ..... 439/516
(58) Field of Search ..... 439/76.2, 516, 439/43

(56) References Cited

U.S. PATENT DOCUMENTS

| | | | | | |
|---|---|---|---|---|---|
| 4,221,455 | A | | 9/1980 | Cairns et al. | 339/186 M |
| 4,508,399 | A | * | 4/1985 | Dowling et al. | 439/516 |
| 4,689,718 | A | | 8/1987 | Maue et al. | 361/360 |
| 4,944,691 | A | * | 7/1990 | Marach | 439/516 |
| 4,963,107 | A | * | 10/1990 | Koster | 439/516 |
| 5,285,011 | A | | 2/1994 | Shimochi | 174/52.1 |
| 5,434,749 | A | | 7/1995 | Nakayama | 361/775 |
| 6,045,412 | A | | 4/2000 | Guanco et al. | 439/752 |
| 6,051,782 | A | | 4/2000 | Wagner | 174/52.1 |
| 6,126,458 | A | | 10/2000 | Gregory, II et al. | 439/76.2 |
| 6,174,204 | B1 | | 1/2001 | Boivin | 439/621 |
| 6,371,799 | B1 | * | 4/2002 | Alfaro et al. | 439/516 |
| 6,488,534 | B2 | * | 12/2002 | Soga et al. | 439/516 |
| 2001/0049211 | A1 | | 12/2001 | Sumida et al. | 439/76.2 |
| 2002/0009907 | A1 | | 1/2002 | Kasai et al. | 439/76.2 |

* cited by examiner

*Primary Examiner*—Gary Paumen
(74) *Attorney, Agent, or Firm*—Tracey D. Beiriger

(57) ABSTRACT

A bussed electrical center for providing customizable current flow to electrical output components. An upper insulating layer has a first and second faces and exhibits a plurality of apertures through which are engaged male terminals pins, these further in operative communication with the electrical output components. A lower insulating layer has first and second faces exhibiting an apertured pattern according to a first specified configuration. A conductive grid overlays the first face of the lower insulating layer, an apertured pattern being defined in the grid according to a second specified configuration and further defined by interconnecting web portions, exposed by the apertured pattern in the lower insulating layer. Upon assembly of the insulating layers, with the grid stacked together, exposed web portions of the grid capable of being sectioned through the apertured pattern in the lower insulating layer and to establish a selected current flow direction across the grid.

20 Claims, 12 Drawing Sheets

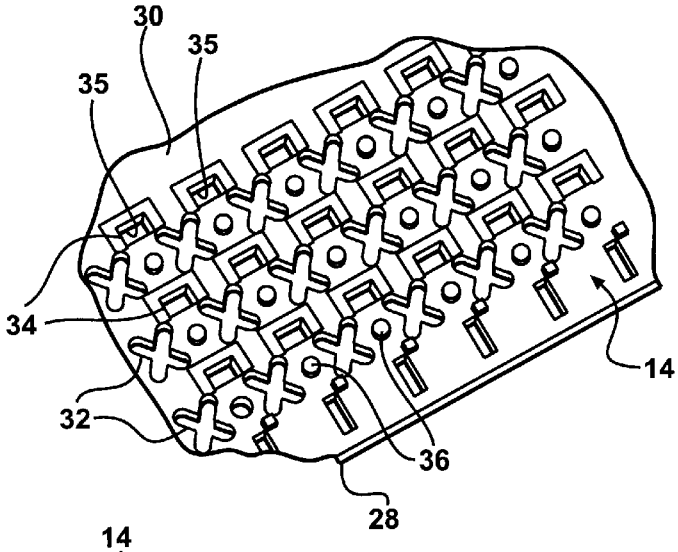
FIG -15
FIG - 16
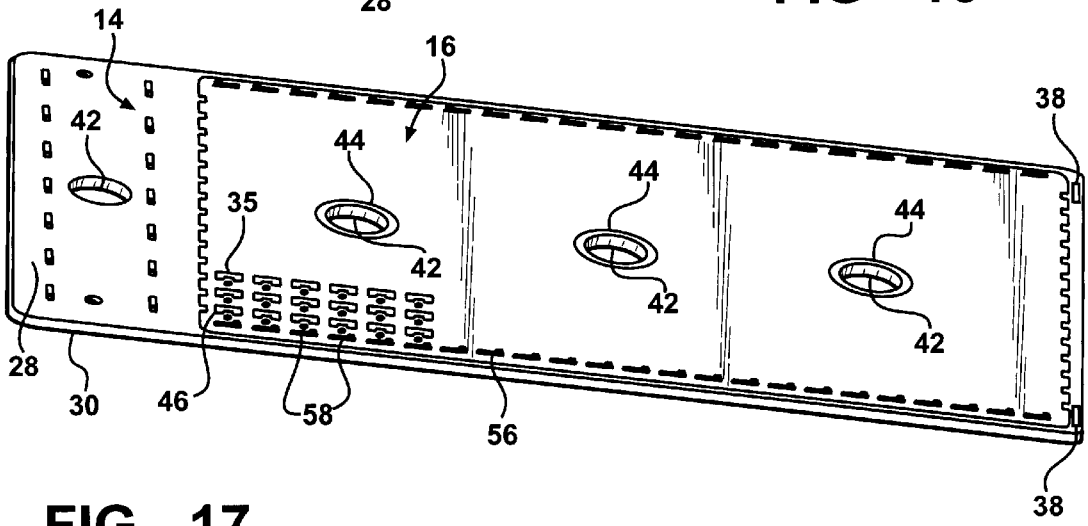
FIG - 17
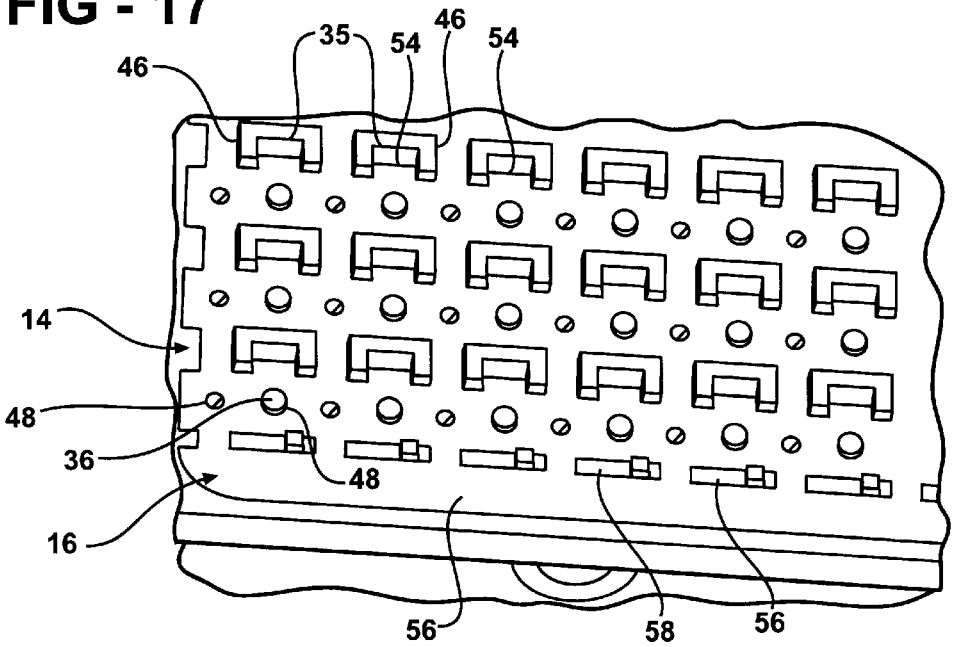

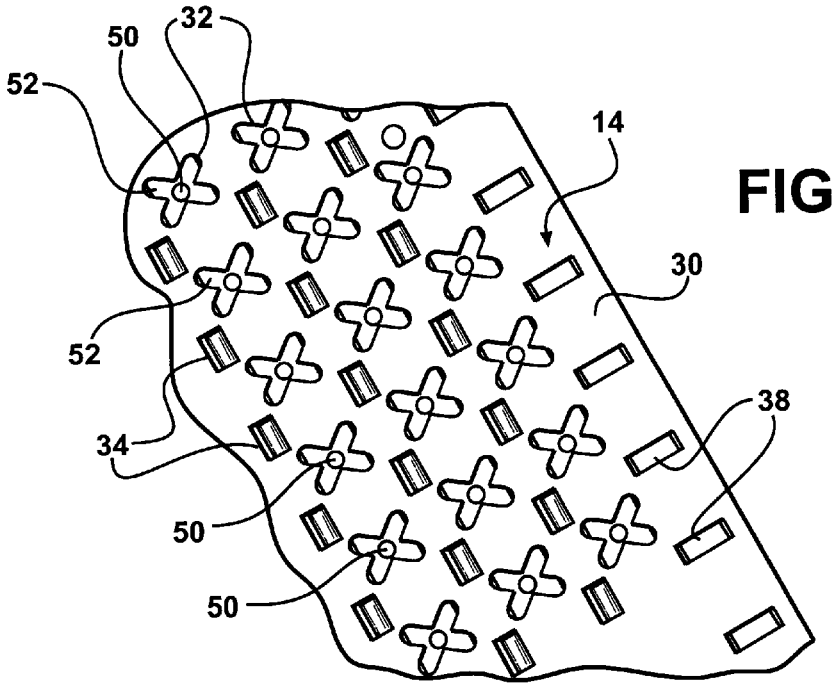
FIG - 18
FIG - 19
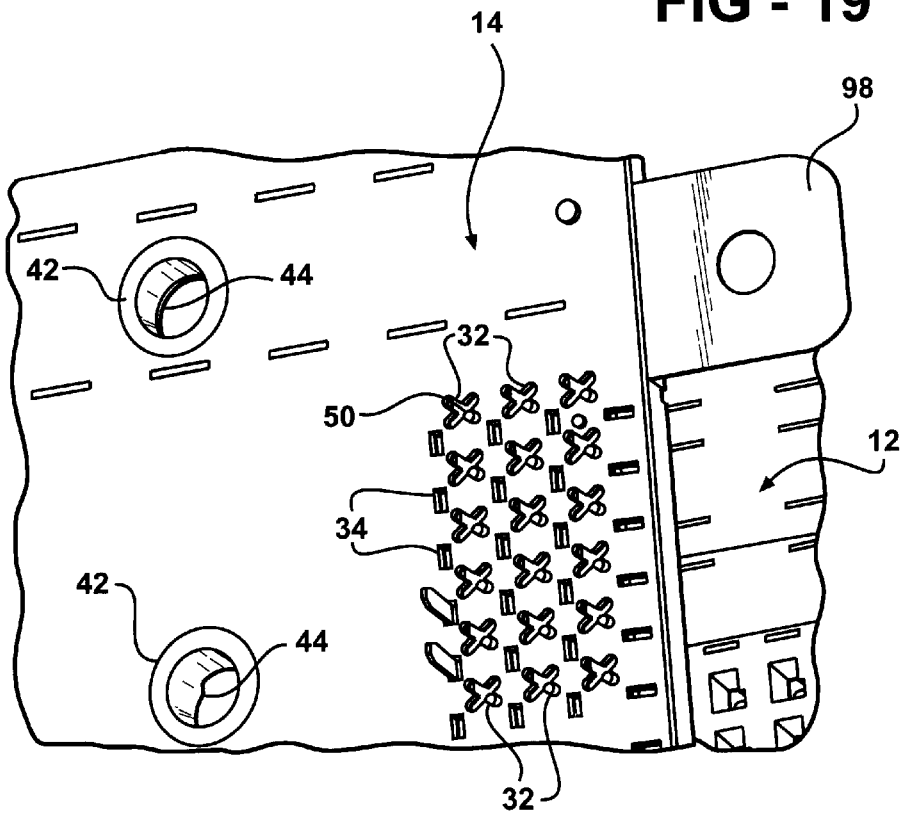

BUSSED ELECTRICAL CENTER INCORPORATING MODULARIZED COMPONENTS AND SECTIONABLE CONDUCTOR GRID FOR ESTABLISHING PREFERRED HIGH CURRENT FLOW APPLICATIONS

FIELD OF THE INVENTION

The present invention relates generally to bussed electrical centers for converting a high current input to specified and stepped-down current outputs for use in such as vehicle power output applications. More particularly, the present invention discloses a bussed electrical center incorporating pluralities of female/male terminals, bussed high current female terminals, modular main bus bars and a stackable sandwiching grid assembly which is capable of being mechanically sectioned (reconfigured) to determine a selective direction of current flow through the electrical center and to the various output components.

BACKGROUND OF THE INVENTION

The prior art is well documented with various types of powered electrical distribution centers, such as which are particularly employed in vehicle applications for subdividing and rerouting an input power source (vehicle battery or the like) to a variety of output applications. Such power distribution centers typically further employ conventional electrical output components, these further including relays, switches, diodes, etc., to assist in the routing and necessary step-down of the input current into the desired output current components.

Additional features associated with prior art junction boxes include the provision of fairly low current female terminals (receptors). Additionally, existing bussed terminal and associated fret designs usually need to be customized (such further including the provision of wiring for electrically connecting the different devices) for each vehicle platform application, resulting in increased cost and time and due to the extensive (low current) customizing processes which are required. Additional examples of bussed electrical center assemblies, conventionally known in the prior art, include U.S. Pat. No. 6,126,458, issued to Gregory, II et al., U.S. Patent Application Publications U.S. 2001/0049211 A1, to Sumida et al., and U.S. 2002/0009907 A1, to Kasai et al.

SUMMARY OF THE INVENTION

The present invention is a bussed electrical center for providing customizable and high current flow to a plurality of electrical output components. In particular, the present invention discloses a bussed electrical center, providing higher current flow than preceding assemblies and which incorporates pluralities of female/male terminals, bussed high current female terminals, modular main bus bars and a stackable sandwiching grid assembly. As further previously described, the electrical center of the present invention is capable of being mechanically sectioned (reconfigured) to determine a selective direction of current flow through the electrical center and to the various output components. In this manner, a standard electrical center assembly can be easily modified (reconfigured) without the requirement of specialized tooling, and such as has been previously necessary for creating the bus bar for the electrical center assembly.

The electrical center includes an upper insulating layer having a first face and a second face and exhibiting a plurality of apertures through which are engaged a plurality of stamped terminals. The terminals each include both a female receptor and an oppositely extending and integrally defined male inserting pin and are formed of a conductive and stamped metal. A stem supports and interconnects the oppositely extending and associated female receptor and male inserting pin portions and such that a plurality of such stamped terminals can be provided upon a reel.

In the above manner, a sub-plurality of stamped terminals can be sectioned from the reel and installed in a given application. The terminals are further in operative communication with various electrical output components associated with the electrical distribution assembly, these typically including fuses, relays, switches and the like.

A main bus bar secures upon the first face of the upper insulating layer, the bus bar typically including an elongated and stamped configuration with pluralities of upwardly extending terminal blades arranged in first, second and third rows, the blades being engaged by suitable electrical components. A high current power source communicates with an input location of the main bus bar.

A plurality of high current bussed female terminals are provided, in certain instances in operative communication with the main bus bar, each including a plurality of individual female receptors extending therefrom. The bussed female terminal further comprises an elongated carrier strip and upon which are mounted the plurality of receptors (configured similarly to those associated with the stamped terminals), the bussed female terminals again electrically interconnecting at least one of the main bus bar with other and specified electrical output components, as well as capable of being disposed in electrical communication with other such components inter-communicated by the stamped terminals.

A lower insulating layer is also provided having a first face and a second face and exhibiting an apertured pattern according to a first specified configuration. A conductive grid overlays the first face of the lower insulating layer and defines a further apertured pattern according to a second specified configuration. A plurality of interconnecting web portions are associated with the conductive grid pattern and further includes bent tabs extending from specified locations along the web portions, and further such that certain locations of the web portions are exposed by the apertured pattern defined in the lower insulating layer so that the bent tabs project therethrough.

Upon assembly of the upper and lower insulating layers with the grid sandwiched therebetween, exposed web portions of the conductive grid are capable of being sectioned by an appropriate cutting tool which accesses the web portions exposed by the apertured pattern in the lower insulating layer. In this fashion a selected current flow, either established or prohibited in given directions across the grid, is established in cooperation with the electrical distribution provided through the associated male terminal pins insertably engaged through the assembled upper and lower insulating layers.

BRIEF DESCRIPTION OF THE DRAWINGS

Reference will be made to the attached drawings, when read in combination with the following detailed description, wherein like reference numerals refer to like parts throughout the several views, and in which:

FIG. 15 is an enlarged partial view of the lower insulating layer and further illustrating its associated apertured pattern and which makes possible access of a cutting tool to the sandwiching grid portion for sectioning therefrom specified trace portions of the grid and to define a specified current flow direction;

FIG. 16 is a further rotated illustration of the sandwiching arrangement shown in FIG. 11 between the lower insulating layer and the conductive grid;

FIG. 17 is an enlarged partial view of the sandwiching arrangement shown in FIG. 16 and illustrating the mating relationship defined between the patterns respectively defined on the conductive grid and lower insulating layer;

FIG. 18 is a further and rotated view of the sandwiching arrangement between the conductive grid and lower insulating layer (reversed from that shown in FIG. 17) and illustrating, in particular, the manner in which the holes defined in the grid allow the user to manipulate the tool to separate a specified current flow path;

FIG. 19 is a partial view, from an underside direction, of assembled upper and lower insulating layers and illustrating the electrical communication established between the sandwiched conductive grid and the output bus bar, female/male stamped terminals, etc.;

DETAILED DESCRIPTION OF PREFERRED EMBODIMENTS

Figure 11:
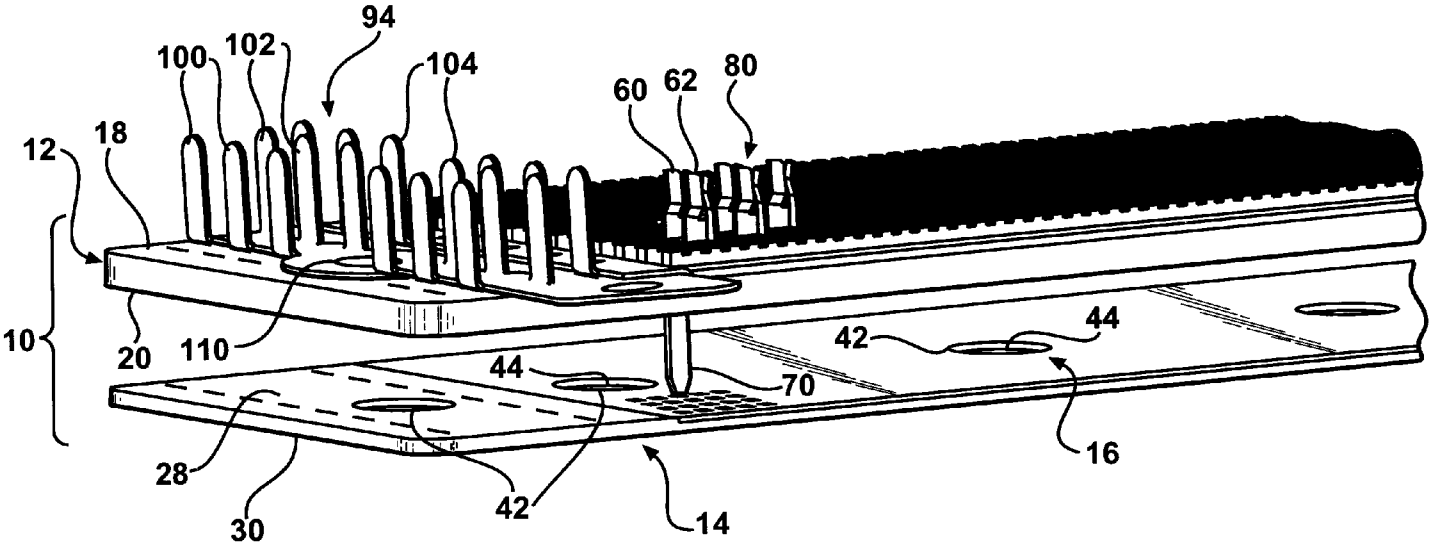
FIG. 11 is a side exploded view, again illustrating the upper insulating layer with assembled components, and in spatially arrayed fashion relative to a lower insulating layer with sandwiching conductive grid according to the bussed electrical center of the present invention.
Figure 21:
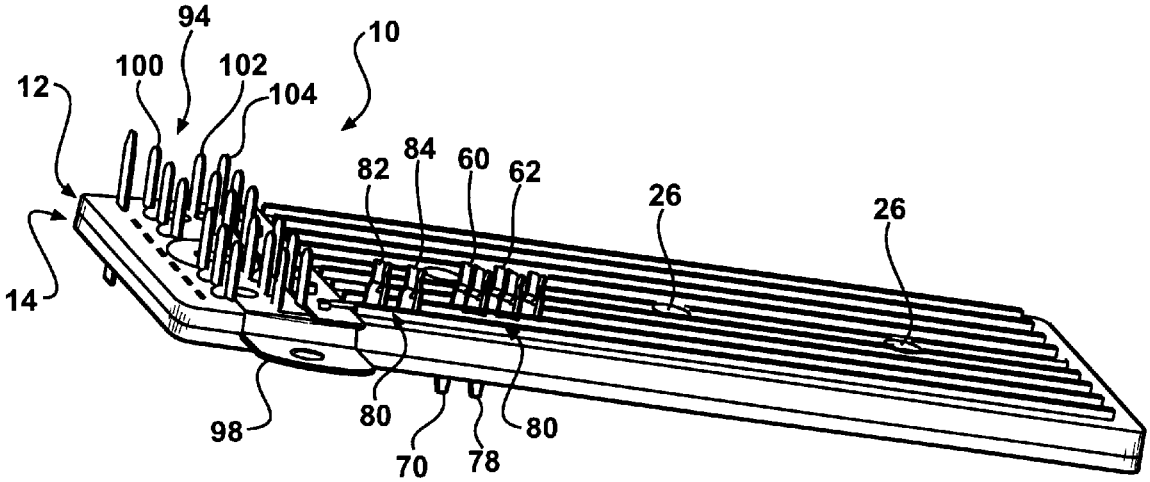
FIG. 21 is an assembled illustration of the bussed electrical center as substantially shown previously in FIG. 11.
Figure 22:
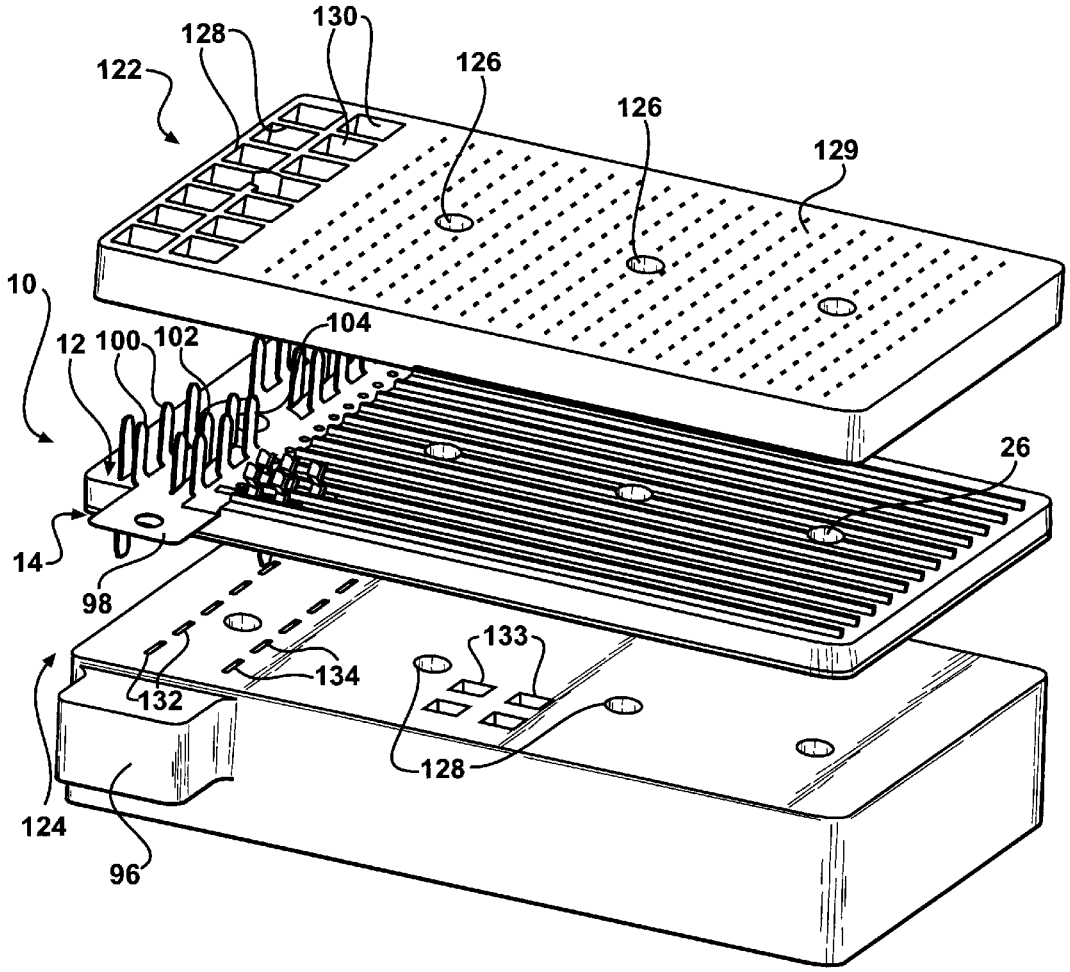
FIG. 22 is a further exploded view of the assembled electrical center in arrayed fashion between upper and lower housing portions.

Referring now to the various drawing illustrations, and in particular to FIGS. 11, 21 and 22, an improved bussed electrical center assembly is illustrated at 10 according to the present invention. As previously explained, the present invention is directed particularly to an improved and sandwiching arrangement of a conductive grid pattern, established between upper and lower insulating layers, and which enables a user to quickly and effectively section trace portions of the grid pattern that are exposed by an overlaying and associated apertured pattern defined in the lower insulating layer. In this manner, the configuration of the conductive grid may be quickly customized, with the requirement of specialized tooling, and in order to alter the direction of current flow across the conductive grid and to output pins and terminals located upon the upper insulating layer. Referring to the various drawing illustrations, an upper insulating layer 12, lower insulating layer 14 and sandwiched conductive grid 16 are provided, these making up the platform upon which the electrical center 10 of the present invention is provided.

Figure 3:
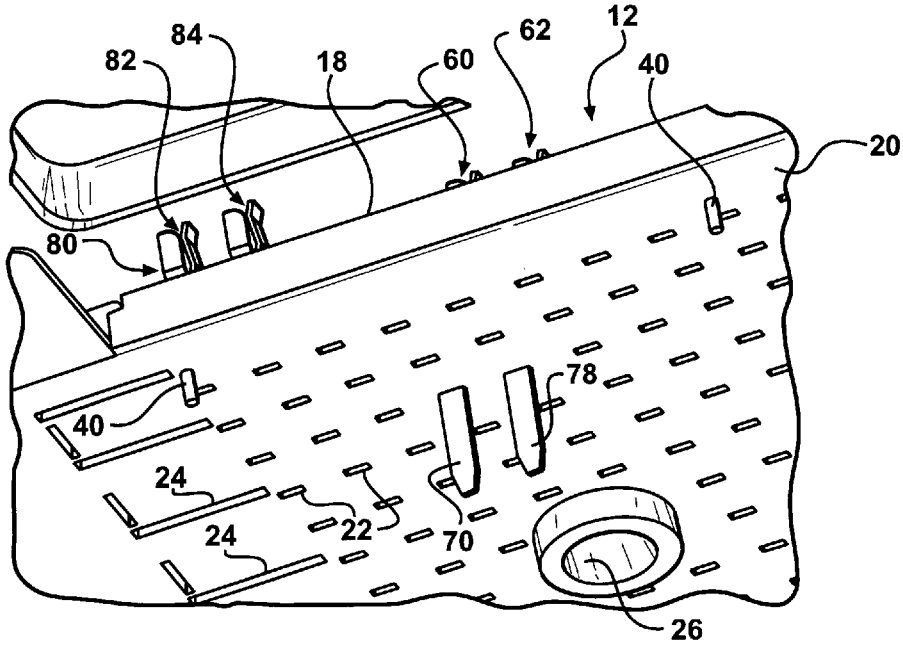
FIG. 3 is an underside perspective view of an upper half of an insulating layer, forming a portion of the electrical center, and illustrating such as the male portions of the dual stamped terminals in insertingly engaged fashion, along with a bussed high current female terminal and a main bus bar secured to the insulating layer and forming portions of the present invention.
Figure 4:
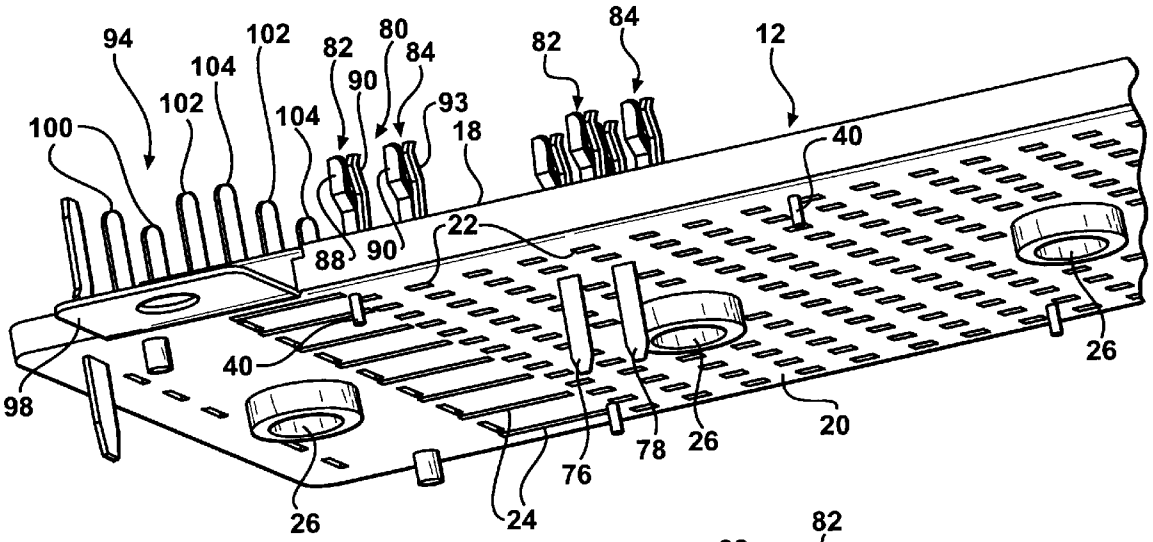
FIG. 4 is a further perspective and partially rotated view of the upper insulating layer illustrated in FIG. 3 and according to the present invention.

Referring in particular to FIGS. 3, 4, 6, 8 and 11, the upper insulating layer 12 is constructed of a suitable plasticized or other electrically insulating material, having a generally rectangular configuration in the embodiment illustrated, and which includes a first face 18 and a second opposite face 20. Pluralities of apertures are defined in the upper layer 12, between the first 18 and second 20 faces and, referring specifically to FIGS. 3 and 4, include a first plurality of apertures 22 (associated with various terminal pins), a second plurality of apertures 24 (corresponding to a main power input bus bar and which will be further explained as receiving a tool to section the main bus into different trace depending current flow), and a third plurality of aperture 26, these being generally circular in configuration and providing access for mounting structure for interengaging with the lower insulating layer 14 and intermediate (sandwiched) conductive grid 16. The apertures 22 are further illustrated only in partially covering fashion over the surface area of the upper insulating layer 12 and it is understood that, such as shown in FIGS. 3 and 4, they extend across substantially the entire area of the upper layer 12.

Figure 14:
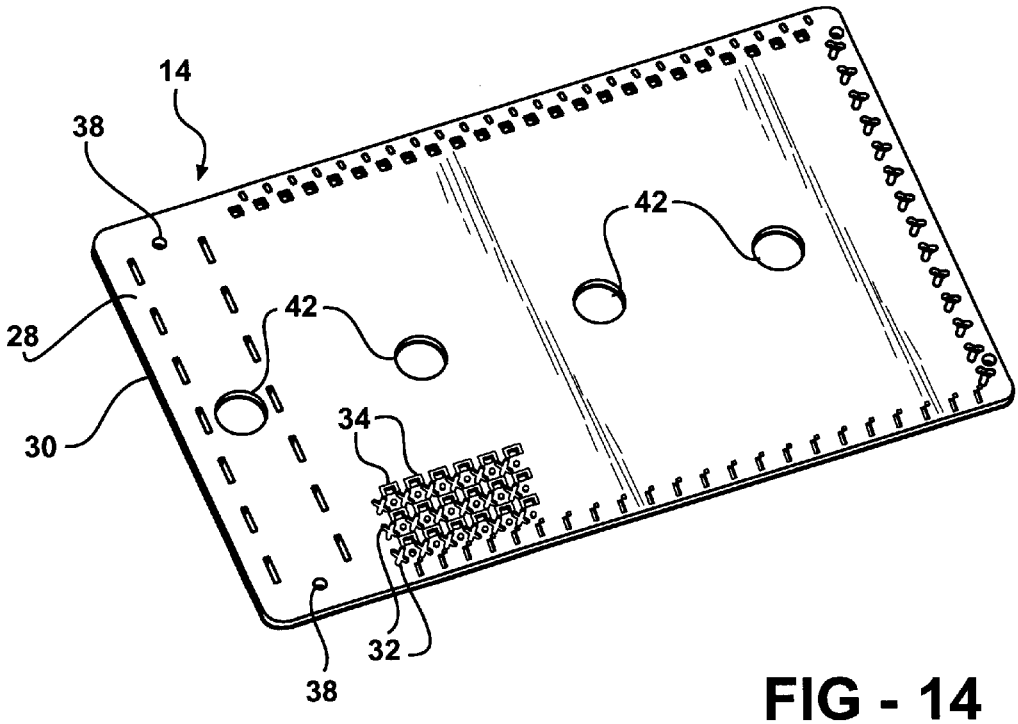
FIG. 14 is a view of the lower insulating layer according to the present invention.

The lower insulating layer 14, as best shown in FIGS. 11 and 14–16, includes a first face 28 and a second face 30 and is constructed both of a similar electrically insulating material and in a similar shape as with respect to the first insulating layer 12. An apertured pattern, see as best illustrated in FIG. 16, is defined through the first and second faces of the lower insulating layer 14 and is defined, in the particular variant illustrated, by a plurality of "X" shaped apertures 32 and, symmetrically arrayed with respect to the "X" shaped apertures, additional window shaped (rectangular) apertures 34. Portions of the material of the lower insulating layer 14 (see at 35), which define the window shaped apertures 34 extend in a reverse facing direction towards the first (or upper) face 28. As best shown in FIG. 14, only a portion of the surface area of the lower layer 14 is illustrated as including the apertured pattern, it being further understood to extend across the substantially entire surface area of the lower layer 14.

The apertured pattern 32 and 34 extends across the width and length of the lower insulating layer 14, the insulating layer 14 further including a plurality of button shaped projections 36 (see again FIG. 15) as well as slot shaped apertures 38 which extend along the peripheral extending edges of the layer 14. Referring again to FIGS. 3 and 4, the second (bottom) face 20 of the upper insulating layer 12 includes a plurality of peripherally located and downwardly projecting pegs 40, these seating within selected apertures 36 and 38 located in the lower insulating layer 14. Additional circular shaped apertures 42 (see in particular FIGS. 11 and 14) correspond in shape and placement with those illustrated at 26 with respect to the upper insulating layer 12.

The lower insulating layer 14 is further configured so that the conductive grid 16 sets thereupon in the manner best illustrated in FIGS. 11 and 16. The grid 16 is constructed of an electrically conductive material, such as copper or the like, and exhibits a similar overall shape as that of the upper 12 and lower 14 insulating layers. A plurality of circular shaped apertures 44 (typically three such apertures) are arranged in a given pattern through the grid 16 and so that, upon placement in the manner again illustrated in FIGS. 11 and 16, the apertures 42 and 44 align.

Figure 12:
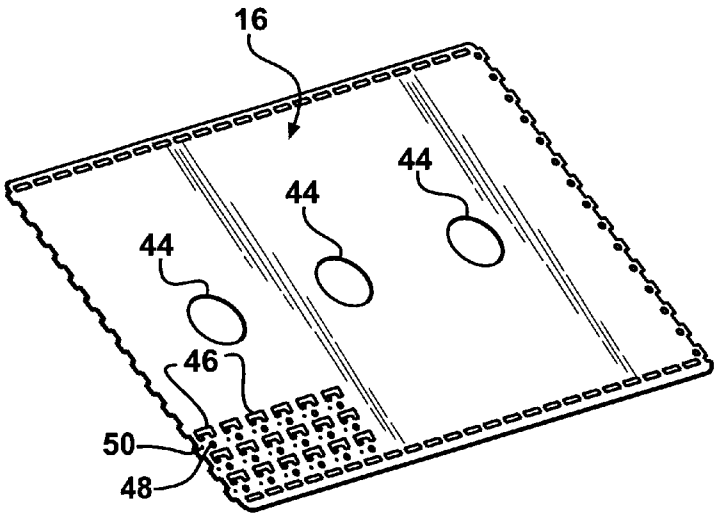
FIG. 12 is a sectional view of conductive grid, also illustrated in FIG. 11 according to the present invention.
Figure 13:
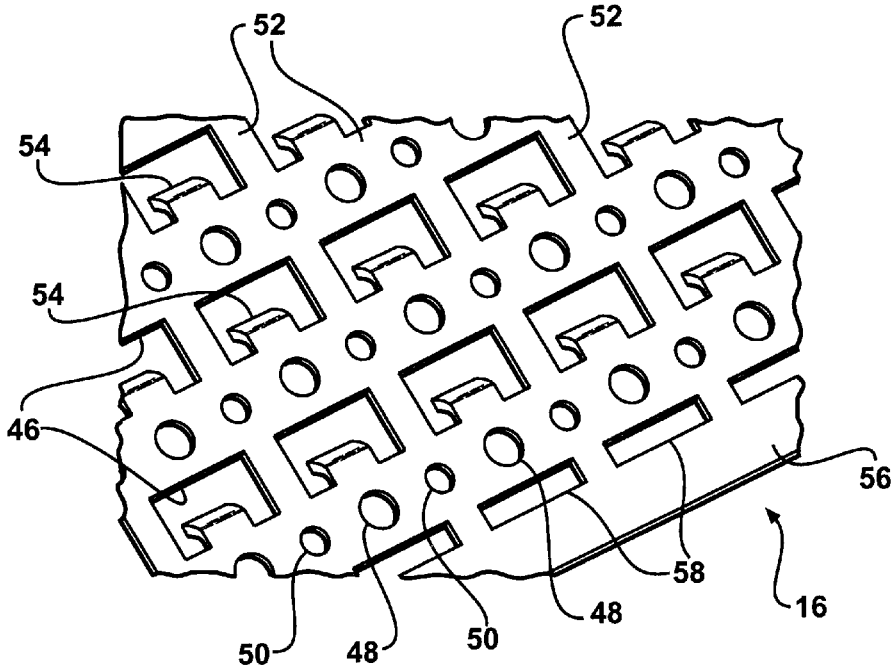
FIG. 13 is an enlarged partial view of the aperture pattern defined in the conductive grid of FIG. 12 and which allows for passage therethrough of insulating portions from the lower insulating layer.

Referring again in particular to FIGS. 12 and 13, the conductive grid 16 further includes an apertured pattern defined by a further plurality of window shaped apertures 46 (see in particular FIG. 13) arranged in a further symmetrical pattern along with pluralities of circular apertures 48 and 50. The apertured pattern defined in the grid 16 is further defined by a plurality of interconnecting web portions 52 (these defining the window shaped apertures 46) as well as a plurality of bent tabs 54 which correspond with each of the window shaped apertures 46 and which extend in a curled and downwardly angled fashion from an associated edge thereof. Referring again to FIG. 12, a carrier strip portion 56 is illustrated along each extending edge of the conductive grid 16 and defines axially extending slots 58 proximate the peripheral extending edges, and such that the grid can be produced from a blank shape utilizing a progressive stamping operation best shown in FIG. 12.

Referring to FIGS. 16 and 17, an upper facing view of the sandwiching engagement of the conductive grid 16 upon the first 28 (or upper) face of the lower insulating layer 14 is shown and by which the extending portions 35 of the insulating layer 14 (these again surrounding and defining the window shaped apertures 34) seat within the like window shaped apertures 46 defined within the conductive grid 16. Concurrently, the button shaped projections 36 of the lower insulating layer 14 (again projecting from its upper or first face 28) seat within the apertures 48 defined through the conductive grid 16. The plastic projections 36 are then staked and the conductive grid 16 is retained within the lower insulating layer 14. Finally, the angled or bent tabs 54, associated with the conductive grid web portions 52, extend through the windowed apertures 34 in the lower insulating layer 14 and in a direction towards the second (bottom) face 30 thereof.

Referring to FIG. 18, a rotated and sandwiching view is illustrated, from the bottom or underside facing side 30 of the lower insulating layer 14, and which illustrates exposed portions of the interconnecting conductive grid web 52 which are revealed by the "X" shaped apertures 32 associated with the apertured pattern of the lower insulating layer 14. In this manner, the trace network of web portions 52 defined by the conductive grid 16 is substantially revealed from the underlying face 30 of the lower insulating layer 14.

As will be subsequently described in additional and further detail with reference to the components assembleable upon the upper insulating layer, it is desirous to define given circuit pathways (or traces) in given directions across the conductive grid 16. By virtue of the design of the overlapping apertured patterns of the conductive grid and lower insulating layer, the web portions 52 (of conductive grid 16) are substantially revealed through the "X" shaped apertures 32 (in lower insulating layer 14) and further so that the associated plurality of apertures 50 in the grid 16 are likewise evident through the "X" shaped apertures. Again referencing FIG. 19, only a portion of the apertured patterns 32 and 34 are shown, it being understood that they extend across substantially the entire surface area of the lower insulating layer 14.

A conventional cutting tool, such as a sharp edged knife or the like (not shown) can be inserted through selected "X" shaped apertures 32 (from the second or bottom facing side 30 of the lower insulating layer 14). In this manner, portions of the interconnecting grid web 52 (such as extending between the associated circular apertures 50 can be cut or sectioned by the tool and without first having to disassemble or otherwise take apart the retaining arrangement established between the lower insulating layers and the grid. The hole 50 and "X" shape 52 arrangement disallows current flowing from one, two, three or four directions (see 50 in FIG. 13) by cutting section along each V branch of associated "X" shape (total four V branches) in FIG. 18. In this manner, an advantage of the ability to quickly section or remove portions of the conductive grid web 52, from the underlaying/bottom facing side 30 of the lower insulating layer 14 is to enable current pathways (or traces) to be quickly defined in the grid 16 and without the requirement of specialized tooling or customizing procedures endemic with prior art electrical center designs.

Figure 5:
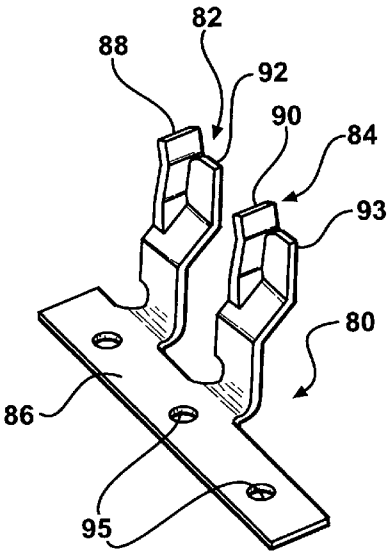
FIG. 5 is a three dimensional perspective view of a bussed high current female terminal, which provides electrical communication from such as the high current bus bars and/or between individual output devices.
Figure 6:
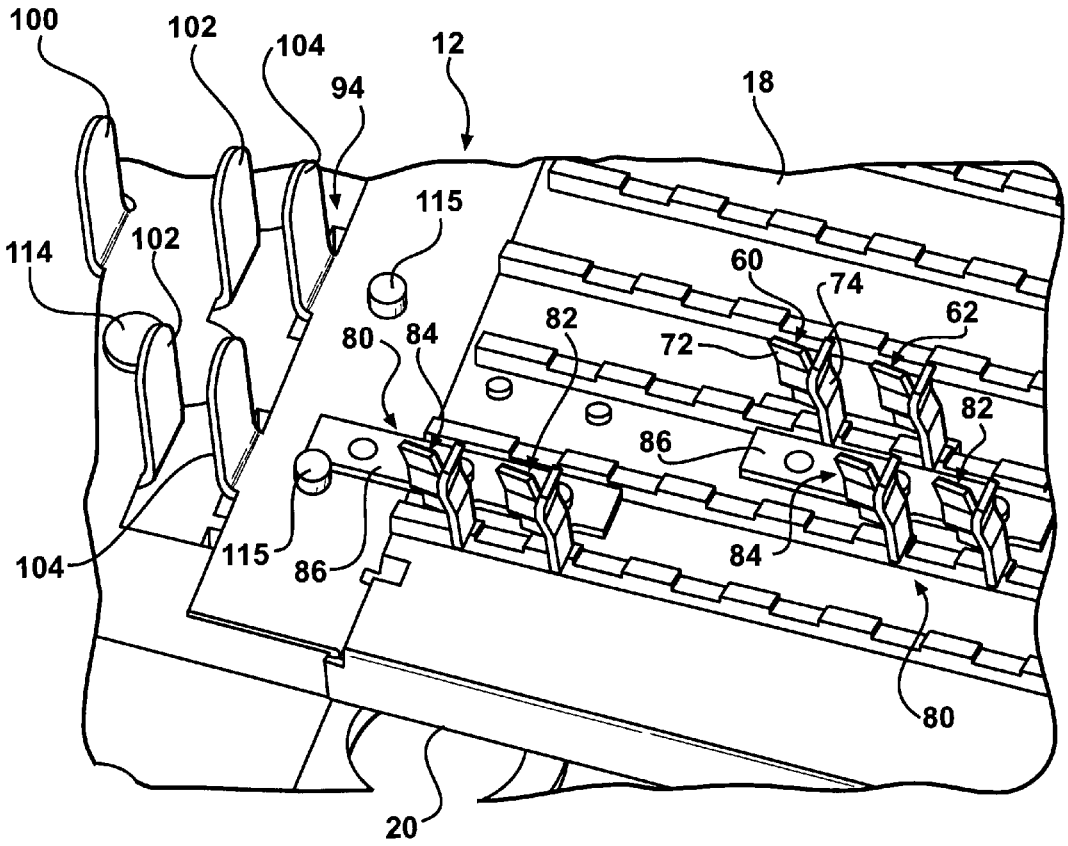
FIG. 6 is a further rotated view of the upper insulator layer, also shown in FIGS. 3 and 4, and illustrating a staking application of a first female terminal to a main bus bar, as well as a second application of a female terminal in communication with a pair of dual female/male stamped terminals.

Upon sectioning or removing portions of the conductive grid web 52 from the underlying/bottom facing side 30 of the lower insulating layer 14, current pathways (or traces) are thus defined. The upper insulating layer 12 is then assembled with the assembly of the conductive grid 16 and lower layer 14. The four projections 40 at the two ends of upper insulator 20 in FIGS. 4 and 5 are seated through holes 38 in FIG. 16. An additional four projections in the middle of the upper insulator 20 will be seated through hole 50 in the conductive grid 16 in FIG. 13. All eight projections are then staked and, therefore, the conductive grid 16 is sandwiched by the upper insulator 14 and lower insulator 12 shown in FIG. 21.

Figure 1:
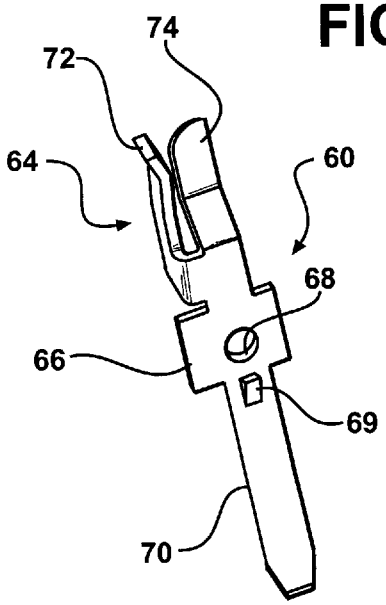
FIG. 1 is a perspective view of a high current carrying dual female/male stamped terminal forming a part of the bussed electrical center according to the present invention.
Figure 2:
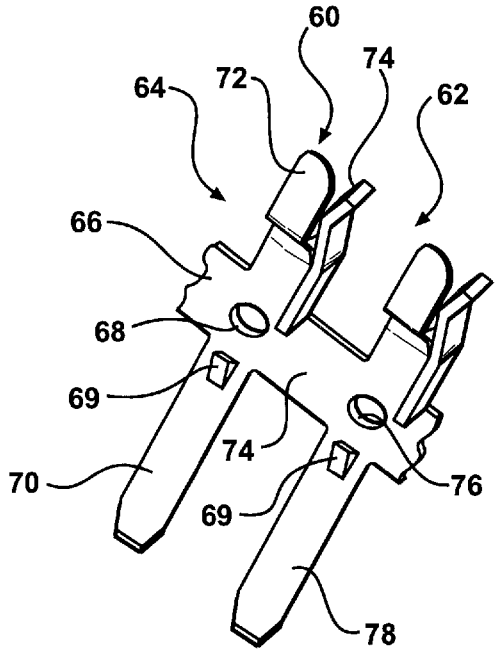
FIG. 2 is a perspective view of a pair of terminals such as illustrated in FIG. 1 and which are illustrated interconnected by a stem portion such that a plurality of such terminals can be provided in reel form.

Having adequately described the construction, configuration and sectioning ability of the conductive grid 16, relative to the sandwiching insulating layers 12 and 14, reference and description will now be made to the additional components associated with the present invention and reference is first made to FIGS. 1 and 2 which illustrate stamped terminal pins 60, 62, et seq. Each of the terminal pins, referencing again in particular pin 60 in FIG. 1, is constructed of an electrically conductive material (such as again a copper or suitable spring steel) and includes an upper female receptor portion (see generally at 64), an interconnecting stem portion 66 (with central aperture 68 defined therethrough) and a lower and opposite/downward extending male terminal pin 70.

Referring again to the given female receptor portion, referenced generally at 64 for first terminal 60, the female receptor is further defined by a first configured and biasing finger 72 extending upwardly from the associated stem portion 66. A second configured and biasing finger 74 extends upwardly from a further location of the associated stem portion 66 in angularly offsetting and disposed fashion and so that the fingers 72 and 74, therebetween, define a seating location for engaging a mini-fuse or relay (see at 76 in assembled view of FIG. 23). In the preferred mounting application, the configured and biasing fingers 72 and 74 are bent and angled, from an initial blank shape to the assembled shape illustrated in FIGS. 1 and 2.

As further illustrated in reference again to FIG. 2, the interconnecting stem portions (see again at 66 as well as further at 74 between terminals 60 and 62) permit any plurality of terminals to be mounted in reel form. By the configuration of the contact beams 72 and 74, the terminals 70 and 78 are in same pitch of a mini fuse and carry more current than other terminals in similar applications. Accordingly, a sub-plurality of two, three or more such terminals 60, 62, et seq., can be sectioned from the reel by cutting an associated succeeding stem portion and then mounted to assembled insulating layers and such as by inserting the corresponding male inserting pins (again at 70 and as shown in FIG. 3) through corresponding apertures 22 defined in the first or upper insulating layer 12.

Figure 20:
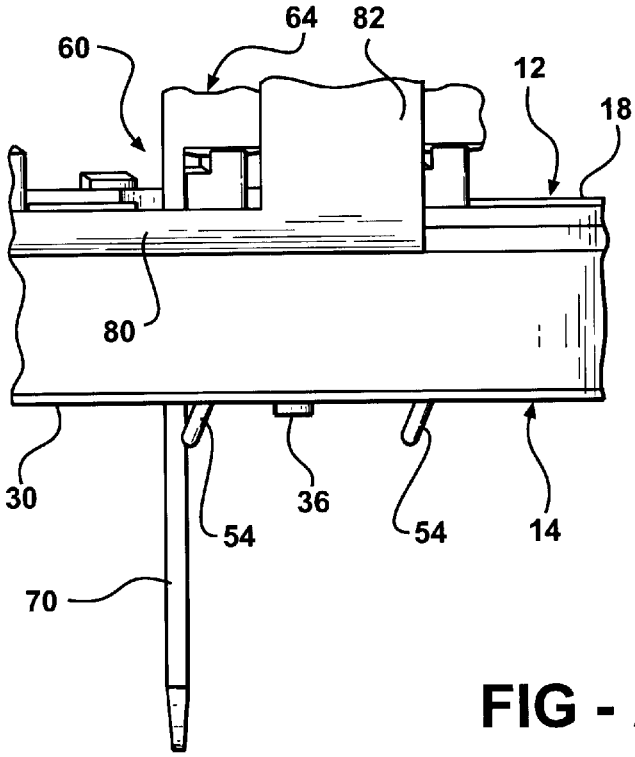
FIG. 20 is an assembled side view of the bussed electrical center and illustrating, by example, the manner in which a male terminal portion engages an associated contact spring portion of the conductive grid.

The male pins 70, see again FIG. 20, extend through the sandwiching insulating layers and grid and project beyond the bottom facing side 30 of the lower insulating layer 14, through associated and aligning windowed apertures 34 and 46, and so that the male pin 70 is biasingly engaged with an associated bent tab 54 of the grid 16 to electrically connect the pin 70 with the grid 16. The apertures defined through the stem portions, see again at 69 in FIGS. 1 and 2, bite through the insulating portion for securing the terminals 60, 62, et seq., upon the upper insulating layer 12 and so that their associated and downwardly extending pins, again at 70 as well as at 78 in FIG. 2, extend through the sandwichingly engaged insulating layers and grid.

Referring to FIG. 5, a high current bussed female terminal is illustrated at 80 and includes a plurality of individual female receptors, see such as at 82 and 84 generally, the bussed female terminal further comprising an elongated carrier strip 86 upon which are mounted the plurality of receptors. As with the associated female housing portions of the stamped terminals, each of the female receptors further comprising a first configured and biasing finger, see at 88 and 90, extending upwardly from the associated stem or carrier strip portion 86. After the terminal is shipped in reel form and ready to be assembled, second configured and biasing fingers, 92 and 93, respectively, are bent upwardly from the associated stem portion in angularly disposed fashion relative to the first biasing fingers 88 and 90, and is again configured to engage a mini fuse or relay (such as previously identified at 76 in FIG. 23). Again, by this configuration of contact beams 93 and 90, the terminals 82 and 84 are in the same pitch of a mini fuse and such that they carry more current than other terminals in similar applications.

Figure 9:
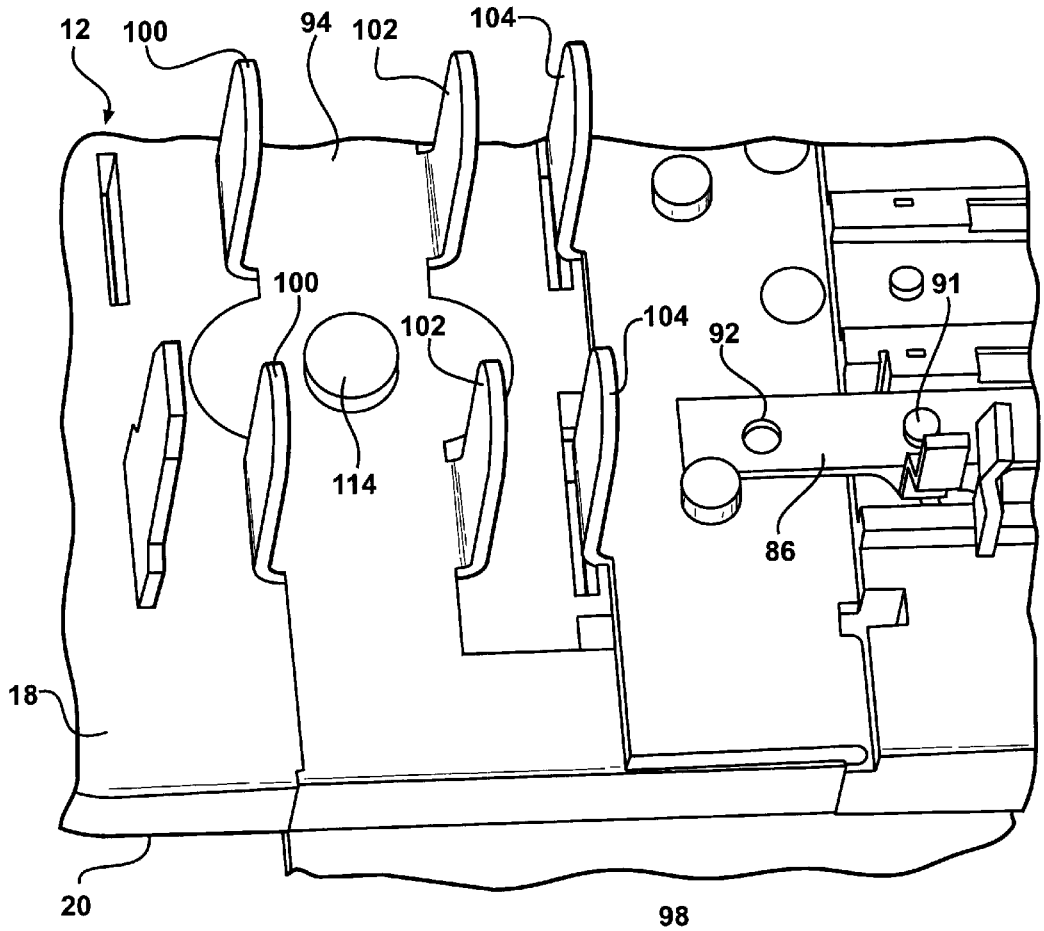
FIG. 9 is an enlarged illustration of FIG. 8 and showing the staking of the bussed female terminals to the main bus, such as by welding or other suitable mechanical joining.

Apertures 95 are defined in the carrier strip 86 for staking the bussed female terminal 80 upon the first face 18 of the upper insulating layer 12 (see also at 91 in FIG. 9). The bussed female terminal 80 electrically interconnects at least one of a main bus bar 94 (see FIGS. 4 and 6–9 and such as by welding or other mechanical joinings) with specified electrical output components and between specified terminals, see stampings 60 and 62 in FIGS. 4, 6 and 8.

In the instance of either bussed female terminal 80, the female receptor portions are typically again reconfigured or bent from a blank shape and in order to define the desired configuration.

Referring again to FIGS. 4 and 6–9, the bus bar 94 secures upon the first, or upper, face 18 of the upper insulating layer 12, a high current power source (see at 96 in FIG. 23) communicating with an inlet end 98 of the bus bar 94. The bus bar 94 is typically constructed of copper material and has an elongated and stamped configuration exhibiting a plurality of upwardly extending terminal blades arranged in first 100, second 102 and third 104 rows, these in turn being engaged by suitable electrical components and as are further referenced by J-case fuses 106 and 108 in the assembled view of FIG. 23.

Figure 7:
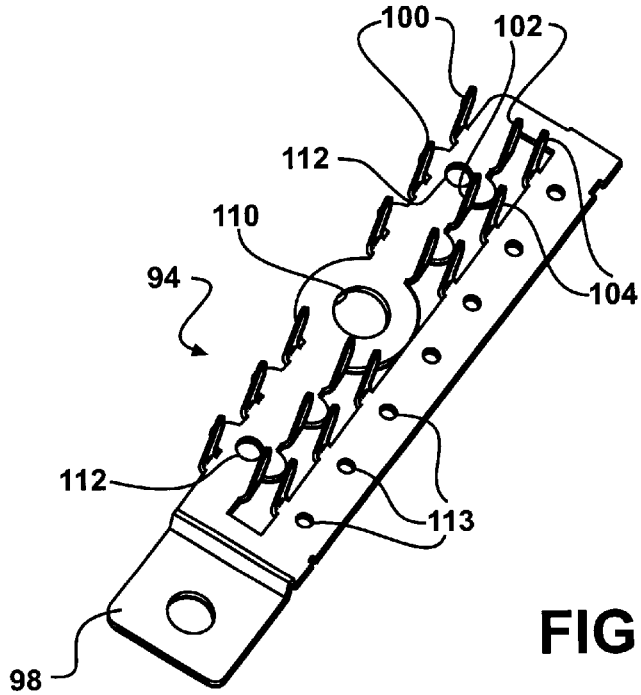
FIG. 7 is a view of a main bus bar having a three-blade row configuration, as well as a plurality of apertures formed therethrough.
Figure 8:
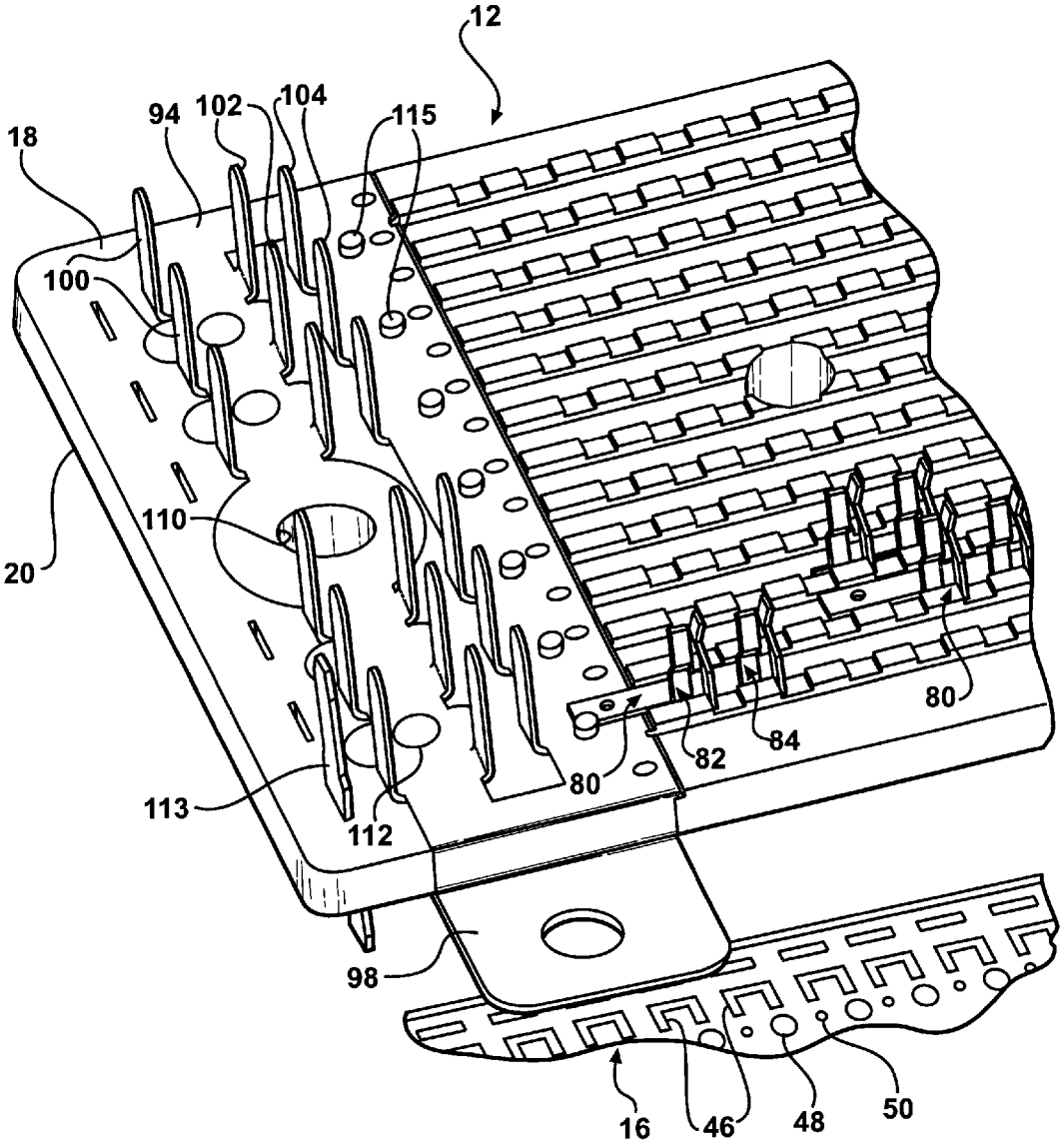
FIG. 8 is a further perspective view of the upper insulating layer and illustrating a plurality of plastic (insulating) staking portions for securing the main bus bar upon the insulating layer.
Figure 10:
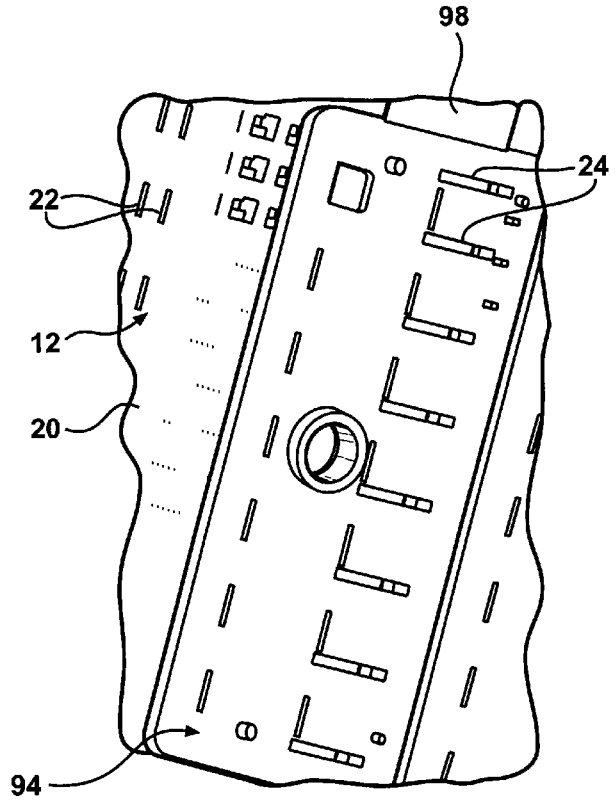
FIG. 10 is an underside view illustration of the manner of engagement of the main bus bar to the upper insulating layer and also illustrating, again from an underside perspective, an upper housing portion of the bussed electrical center with a series of slots allowing a tool to section the main bus, if needed.

Apertures, such as at 110, 112 and 113 in FIG. 7, are further defined through the elongated and stamped configuration of the bus bar 94 at specified locations. These apertures align with suitable additional apertures defined through the upper insulating layer 12 and through which are inserted insulating portions, see further at 114 and 115 for staking the bus bar 94 upon the upper insulating layer 12. After having staked together, the web containing holes 113 can be sectioned into different traces to vary the current flow by applying a cutting tool through apertures 24 in FIGS. 3, 4 and 10.

Accordingly, the bussed center operates on the delivery to the main bus bar 94 of current from the input power source 96 (again FIG. 23) which is delivery via the inlet end 98 extending laterally from the side of the upper insulating layer 12 upon staking the bus bar 94 thereupon. The high current input is then either stepped down or rerouted through the bussed female terminal 86 and then via the relays, switches or the like 106 and 108, engageable upon the plurality of pin rows 100, 102 and 104, or is delivered to the various output terminals 60, 62, et seq. and to additional electrical components, referenced by example at 116, 118, 120, et seq. in FIG. 23, which are secured upon the terminals 60, 62, et seq., via the bussed female terminals 80, female-male terminals 70, as well as the interconnecting and dedicated trace patterns defined within the sandwiched grid 16.

Referring again to FIG. 20, an assembled side view is shown of the bussed electrical center and illustrating, by example, the manner in which the male terminal pin portion 70 engages an associated contact spring portion 54 of the conductive grid 16 which has extended below the bottom or second lower face 30 of the insulating layer 14. Portions of the bussed female terminal 80, female receptor 82 and associated and interengaging stamping 60 and female receptor 64 are also illustrated in FIG. 20.

Referring to FIG. 22, an assembled illustration of the bussed electrical center as substantially shown previously in FIGS. 11 and 21, and includes upper 122 and lower 124 housing portions assembleable about the sandwiching insulating layers 12 and 14 and conductive grid 16. The housing portions 122 and 124 are also preferably constructed of an insulating material, a plurality of mounting holes 126 and 128, respectively, are defined through each of the upper housing portion 122, the lower housing portion 124 and the assembled insulating layers 12 and 14 and grid 16 and which, upon assembly, align for receiving in inserting fashion therethrough mounting fasteners 130, see again FIG. 23.

The upper housing portion 122 exhibits pluralities of apertures aligning with those defined through said upper insulating layer, see at 128 and 130, and in order to seatingly receive the J-case fuses, etc., 106 and 108. The lower housing portion 124 exhibits further pluralities of apertures 132 and 134, aligning with those defined through the upper and lower insulating layers 12 and 14. Similarly, the upper housing portion 122 exhibits pluralities of apertures aligning with those defined through said upper insulating layer, see at 129, and in order to seatingly receive switches, diodes, mini fuses, relays, etc., 76, 116 and 118 in FIG. 23. The lower housing portion 124 exhibits further pluralities of apertures 133, aligning with those at 129 defined through the upper and lower insulating layers 12 and 14.

Figure 23:
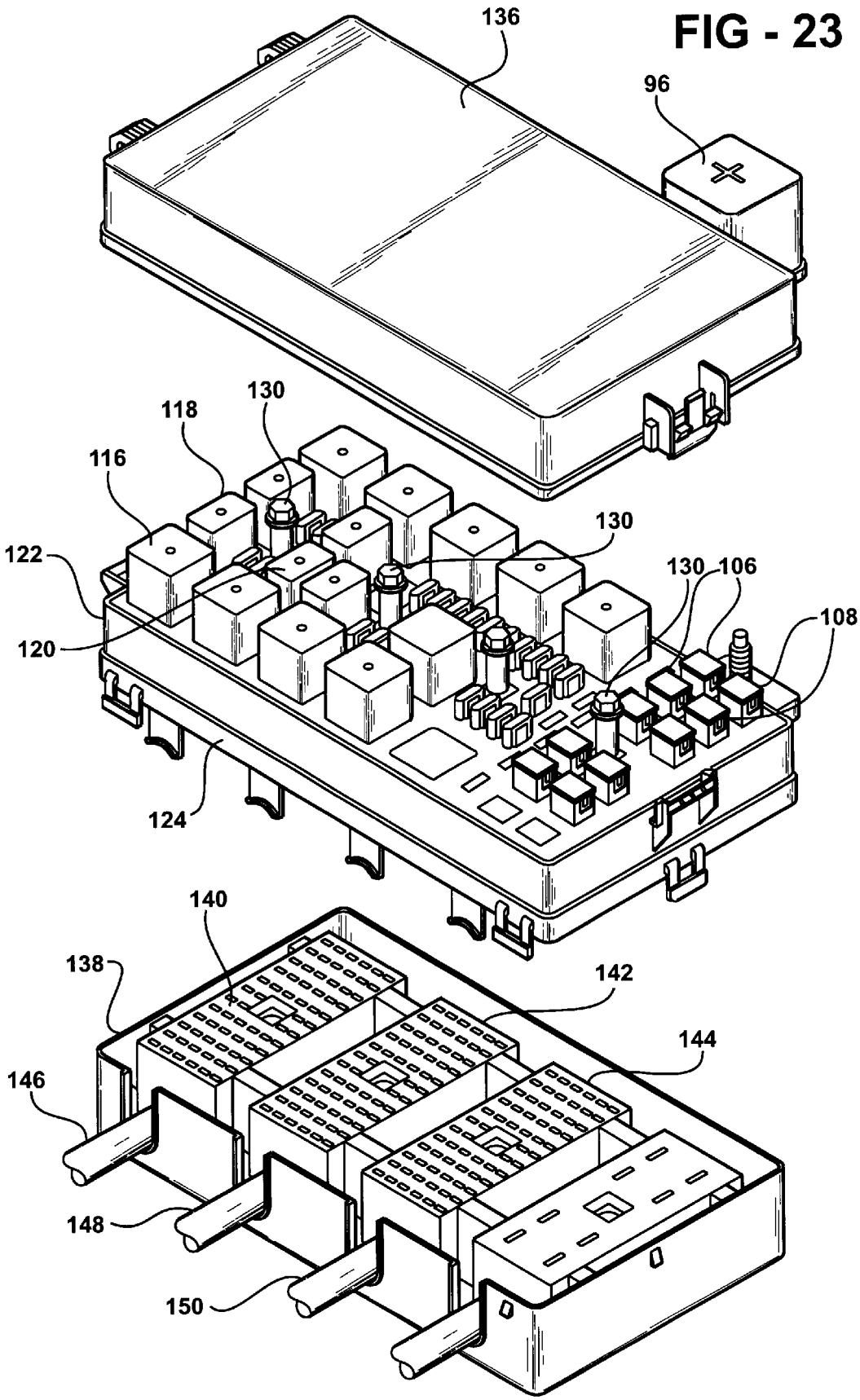
FIG. 23 is a yet further exploded view illustrating the assembled electrical center, with various electrical output components such as fuses, relays, switches and the like, in inter-disposed fashion between an upper covering portion and a lower base portion incorporating output modules and harnesses.

Referring finally to FIG. 23, three dimensionally configured upper cover 136 and lower base 138 portions are provided, the cover 136 and base 138 assemble over a subassembly defined by the assembled housing portions 122 and 124, insulating layers 12 and 14 and conductive grid 16 and further defining a first high current input and a plurality of distributed current outputs. The lower base portion 138 further includes a plurality of molded female connector blocks 140, 142, 144, et seq., supported thereupon and which are engageable with the terminal pins inserting through the insulating layers and conductive grid. Electrical output harnesses 146, 148, 150, et seq., extending from each of the female connector blocks and to various external locations in the vehicle.

Having described our invention, other and additional preferred embodiments will become apparent to those skilled in the art to which it pertains and without deviating from the scope of the appended claims.

We claim:

1. A bussed electrical center for providing customizable and high current flow to a plurality of electrical output components, said electrical center comprising:

an upper insulating layer having a first face and a second face and exhibiting a plurality of apertures through which are engaged a plurality of male terminals pins, said terminal pins being in operative communication with the electrical output components;

a lower insulating layer having a first face and a second face and exhibiting an apertured pattern according to a first specified configuration;

a conductive grid overlaying said first face of said lower insulating layer, an apertured pattern defined in said grid according to a second specified configuration and which is further defined by a plurality of interconnecting web portions which are exposed by said apertured pattern defined in said lower insulating layer;

upon assembly of said lower insulating layers with said grid staked therebetween, exposed web portions of said conductive grid capable of being sectioned through said apertured pattern in said lower insulating layer to establish a selected current flow direction across said grid; and upon said grid being sectioned through said apertured pattern in said lower insulating layer to establish a selected current flow direction across said grid, said upper insulator being assembled and staked to said conductive grid and lower insulator.

2. The bussed electrical center as described in claim 1, said conductive grid further comprising a plurality of bent tabs extending from specified locations along said web portions and projecting through said apertured pattern defined in said lower insulating layer, said terminal pins biasingly engaging selected tabs upon being insertably engaged through said assembled upper and lower insulating layers.

3. The bussed electrical center as described in claim 1, said upper and lower insulating layers each exhibiting an overall rectangular configuration with a specified length, width and thickness and being constructed of a plasticized material.

4. The bussed electrical center as described in claim 1, said conductive grid exhibiting an overall rectangular configuration with a specified length, width and thickness and being constructed of a copper material.

5. The bussed electrical center as described in claim 1, said terminal pins further comprising at least one dual stamped terminal pin exhibiting a female receptor terminal integrally formed atop said male terminal pin.

6. The bussed electrical center as described in claim 5, further comprising a stem for supporting and interconnecting a plurality of said terminal pins, portions of said stem separating said female receptor terminals from said male terminal pins, said stem, upon inserting said male terminal pins through said insulating layers and said conductive grid, shouldering against said first face of said upper insulating layer.

7. The bussed electrical center as described in claim 6, each of said female receptors further comprising a first configured and biasing finger extending upwardly from said associated stem portion, a second configured and biasing finger extending upwardly from said associated stem portion in angularly disposed fashion relative to said first biasing finger, said upward configuration being created by bending said biasing fingers relative to said stem portion 90 degrees after removing said terminals from a reel.

8. The bussed electrical center as described in claim 7, an aperture being defined through each of said stem portions and so that, upon inserting an insulating portion therethrough, said terminal pin is secured at a specified location atop said upper insulating layer.

9. The bussed electrical center as described in claim 1, further comprising a main bus bar securing upon said first face of said upper insulating layer, a high current power source communicating with an inlet end of said bus bar.

10. The bussed electrical center as described in claim 9, said bus bar further comprising an elongated and stamped configuration exhibiting a plurality of upwardly extending terminal blades arranged in first, second and third rows.

11. The bussed electrical center as described in claim 10, a plurality of apertures further being defined through said elongated and stamped configuration of said bus bar at specified locations and through which are inserted insulating portions for staking said bus bar to said upper insulating layer.

12. The bussed electrical center as described in claim 9, further comprising at least one high current bussed female terminal including a plurality of individual female receptors, said bussed female terminal further comprising an elongated carrier strip and upon which are mounted said plurality of receptors.

13. The bussed electrical center as described in claim 12, each of said female receptors further comprising a first configured and biasing finger extending upwardly from said associated stem portion, a second configured and biasing finger extending upwardly from said associated stem portion in angularly disposed fashion relative to said first biasing finger.

14. The bussed electrical center as described in claim 12, further comprising apertures defined in said carrier strip for staking said bussed female terminal upon said first face of said upper insulating layer, said bussed female terminal electrically interconnecting at least one of said main bus bar with specified electrical output components and between specified terminals.

15. The bussed electrical center as described in claim 1, further comprising upper and lower housing portions assembleable about said sandwiching insulating layers and conductive grid, a plurality of mounting holes defined through each of said upper housing portion, said lower housing portions and said assembled insulating layers and grid and which, upon assembly, align for receiving in inserting fashion therethrough mounting fasteners.

16. The bussed electrical center as described in claim 15, said upper housing portion exhibiting a plurality of apertures aligning with those defined through said upper insulating layer, said lower housing portion exhibiting a further plurality of apertures aligning with those defined through said lower insulating layer.

17. The bussed electrical center as described in claim 16, said assembled housing portions and inner insulating layers exhibiting a specified shape and size, the plurality of electrical components further including at least one of relays, switches and diodes secured upon an exterior face of said assembled upper housing portion and electrically communicable with said upper insulating layer.

18. The bussed electrical center as described in claim 17, further comprising three dimensionally configured upper cover and lower base portions, said cover and base assembling over a subassembly defined by said assembled housing portions, insulating layers and conductive grid and further defining a first high current input and a plurality of distributed current outputs.

19. The bussed electrical center as described in claim 18, said lower base portion further comprising a plurality of molded female connector blocks supported thereupon and which are engageable with said terminal pins inserting through said insulating layers and conductive grid, electrical output harnesses extending from each of said female connector blocks.

20. A bussed electrical center for providing customizable and high current flow to a plurality of electrical output components, said electrical center comprising:

an upper insulating layer having a first face and a second face and exhibiting a plurality of apertures through which are engaged a plurality of stamped terminals, each of said terminals including a female receptor and an oppositely extending and male inserting pin, said terminals being in operative communication with the electrical output components;

a main bus bar securing upon said first face of said upper insulating layer, a high current power source communicating with said main bus bar, said bus bar further comprising an elongated and stamped configuration exhibiting a plurality of upwardly extending blades arranged in specified rows;

upon staking of said main bus with said upper insulating layer, exposed web portions of said main bus being capable of being sections through said apertured pattern in said upper insulating layer to establish a selected current flow direction across main bus;

at least one high current bussed female terminal including a plurality of individual female receptors, said bussed female terminal further comprising an elongated carrier strip and upon which are mounted said plurality of receptors, said bussed female terminal electrically interconnecting at least one of said main bus bar with specified electrical output components and between specified terminals;

a lower insulating layer having a first face and a second face and exhibiting an apertured pattern according to a first specified configuration;

a conductive grid overlaying said first face of said lower insulating layer, an apertured pattern defined in said grid according to a second specified configuration and which is further defined by a plurality of interconnecting web portions and bent tabs extending from specified locations along said web portions, said web portions are exposed by said apertured pattern defined in said lower insulating layer and further so that said bent tabs project therethrough; and upon assembly of said lower insulating layers with said grid staked therebetween, exposed web portions of said conductive grid are capable of being sectioned through said apertured pattern in said lower insulating layer to establish a selected current flow direction across said grid, said terminal pins biasingly engaging selected tabs upon being insertably engaged through said assembled upper and lower insulating layers.

* * * * *